US005096792A

United States Patent [19]

Simpson et al.

[11] Patent Number: 5,096,792

[45] Date of Patent: Mar. 17, 1992

[54] PLYWOOD EFFECT SUPPRESSION IN PHOTOSENSITIVE IMAGING MEMBERS

[75] Inventors: Yonn K. Simpson, Fairport; Edward F. Grabowski, Webster; Donald J. Teney, Rochester, all of N.Y.

[73] Assignee: Xerox Corporation, Stamford, Conn.

[21] Appl. No.: 546,990

[22] Filed: Jul. 2, 1990

[51] Int. Cl.[5] ..... G03G 5/10

[52] U.S. Cl. ..... 430/58; 430/60; 430/62; 430/131

[58] Field of Search ..... 430/60, 69, 58, 62

[56] References Cited

U.S. PATENT DOCUMENTS 4,618,552 10/1986 Tanaka et al. ..... 430/60

4,797,336 1/1989 Honda et al. ..... 430/69

*Primary Examiner*—John Goodrow

[57] ABSTRACT

A layered photosensitive imaging member is modified to reduce the effects of interference within the member caused by reflections from coherent light incident on a base ground plane. The modification described is to form the ground plane surface with a rough surface morphology by various selective deposition methods. In one method the metal forming the ground plane is deposited through a fine mesh screen which is either held stationary during a single pass or alternatively vibrated at a specific frequency during a single pass of deposition. Light reflected from the ground plane formed with the rough surface morphology is diffused through the bulk of the photosensitive layer breaking up the interference fringe patterns which are later manifested as a plywood pattern on output prints made from the exposed sensitive medium.

11 Claims, 4 Drawing Sheets

PLYWOOD EFFECT SUPPRESSION IN PHOTOSENSITIVE IMAGING MEMBERS

BACKGROUND AND PRIOR ART STATEMENT

The present invention relates to an imaging system using coherent light radiation to expose a layered member in an image configuration and, more particularly, to a means and method for suppressing optical interference occurring within said photosensitive member which results in a defect that resembles the grain in a sheet of plywood in output prints derived from said exposed photosensitive member when the exposure is a uniform, intermediate-density gray.

There are numerous applications in the electrophotographic art wherein a coherent beam of radiation, typically from a helium-neon or diode laser is modulated by an input image data signal. The modulated beam is directed (scanned) across the surface of a photosensitive medium. The medium can be, for example, a photoreceptor drum or belt in a xerographic printer, a photosensor CCD array, or a photosensitive film. Certain classes of photosensitive medium which can be characterized as "layered photoreceptors" have at least a partially transparent photosensitive layer overlying a conductive ground plane. A problem inherent in using these layered photoreceptors, depending upon the physical characteristics, is the creation of two dominant reflections of the incident coherent light on the surface of the photoreceptor; e.g., a first reflection from the top surface and a second reflection from the top surface of the relatively opaque conductive ground plane. This condition is shown in FIG. 1; coherent beams 1 and 2 are incident on a layered photoreceptor 6 comprising a charge transport layer 7, charge generator layer 8, and a ground plane 9. The two dominant reflections are: from the top surface of layer 7, and from the top surface of ground plane 9. Depending on the optical path difference as determined by the thickness and index of refraction of layer 7, beams 1 and 2 can interfere constructively or destructively when they combine to form beam 3. When the additional optical path traveled by beam 1 (dashed rays) is an integer multiple of the wavelength of the light, constructive interference occurs, more light is reflected from the top of charge transport layer 7 and, hence, less light is absorbed by charge generator layer 8. Conversely, a path difference producing destructive interference means less light is lost out of the layer and more absorption occurs within the charge generator layer 8. The difference in absorption in the charge generator layer 8, typically due to layer thickness variations within the charge transport layer 7, is equivalent to a spatial variation in exposure on the surface. This spatial exposure variation present in the image formed on the photoreceptor becomes manifest in the output copy derived from the exposed photoreceptor. FIG. 2 shows the areas of spatial exposure variation (at 25×) within a photoreceptor of the type shown in FIG. 1 when illuminated by a He-Ne laser with an output wavelength of 633 nm. The pattern of light and dark interference fringes look like the grains on a sheet of plywood. Hence the term "plywood effect" is generically applied to this problem.

One method of compensating for the plywood effect known to the prior art is to increase the thickness of and, hence, the absorption of the light by the charge generator layer. For most systems, this leads to unacceptable tradeoffs; for example, for a layered organic photoreceptor, an increase in dark decay characteristics and electrical cyclic instability may occur. Another method, disclosed in U.S. Pat. No. 4,618,552 is to use a photoconductive imaging member in which the ground plane, or an opaque conductive layer formed above or below the ground plane, is formed with a rough surface morphology to diffusely reflect the light.

According to the present invention, the interference effect is eliminated by breaking up the coherence of reflections from the surface of the ground plane by a novel process which, in a preferred embodiment, includes forming the ground plane through a screening deposition process which imparts to the ground plane a rough surface morphology. More particularly, the present invention relates to a process for forming a photosensitive imaging member comprising the steps of (1)providing a dielectric substrate, and (2) selectively depositing a metal onto the dielectric substrate through a screen, thereby forming a ground plane on said substrate which a rough surface morphology and overlying said ground plane with at least a charge transport layer and charge generating layer.

DESCRIPTION OF THE INVENTION

Figure 3:
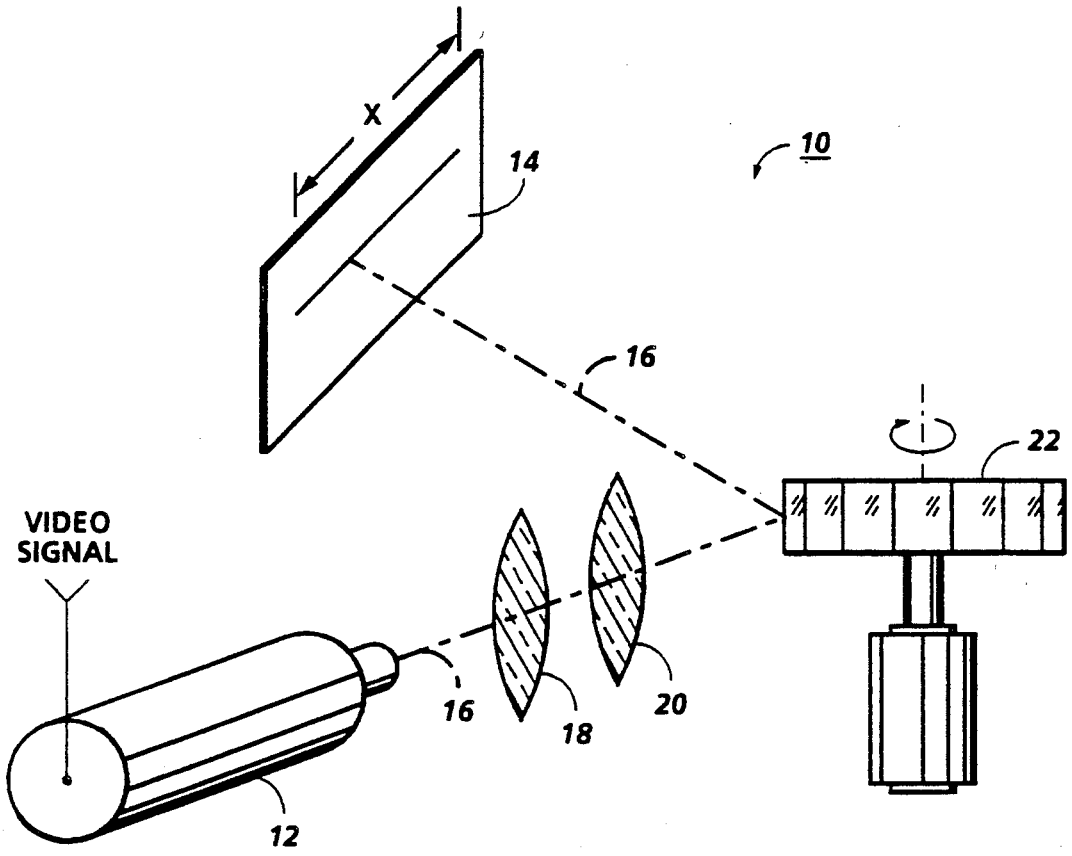
FIG. 3 is a schematic representation of an optical system incorporating a coherent light source to scan a light beam across a photoreceptor modified to reduce the interference effect according to the present invention.

FIG. 3 shows an imaging system 10 wherein a laser 12 produces a coherent output which is scanned across photoreceptor 14. In response to video signal information representing the information to be printed or copied, the laser diode is driven so as to provide a modulated light output beam 16. Flat field collector and objective lens 18 and 20, respectively, are positioned in the optical path between laser 12 and light beam reflecting scanning device 22. In a preferred embodiment, device 22 is a multi-faceted mirror polygon driven by motor 23, as shown. Flat field collector lens 18 collimates the diverging light beam 16 and field objective lens 20 causes the collected beam to be focused onto photoreceptor 14 after reflection from polygon 22. Photoreceptor 14, in a preferred embodiment, is a layered photoreceptor shown in partial cross-section in FIG. 4.

Figure 4:
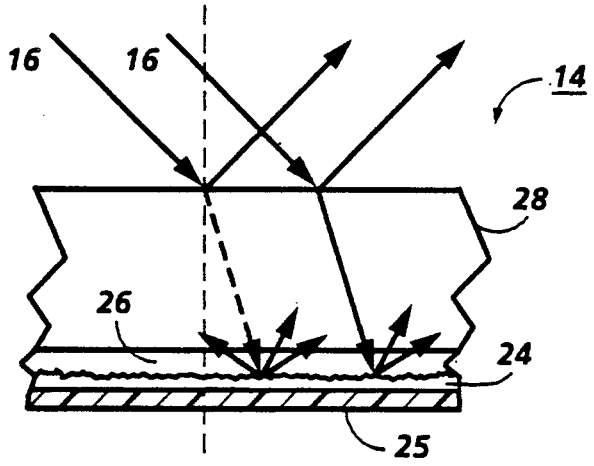
FIG. 4 is a partial cross-sectional view of the photoreceptor of FIG. 3 showing a ground plane with a rough surface morphology formed by a process according to the invention.

Referring to FIG. 4, photoreceptor 14 is a layered photoreceptor which includes a conductive ground plane 24, formed on dielectric 25 (typically polyethylene Terephthalate (PET).) substrate, a charge generating layer 26, and a semi-transparent charge transport layer 28. A photoreceptor of this type (with an unmodified ground plane 24) is disclosed in U.S. Pat. No. 4,588,667 whose contents are hereby incorporated by reference. The ground plane 24 has a roughened surface (shown greatly exaggerated) causing the light rays 16 penetrating through layers 28 and 26 to be diffusely scattered upon reflection from the surface of ground plane 24. This scattering virtually eliminates the unwanted second dominant reflection which would otherwise pass back upwards through the charge and transport layers to cause the spatial variations in exposure at the surface which are referred to in the above background. To achieve the desired scattering effect, the average surface roughness for most systems. In a preferred process mode, the average roughness is approximately $(\frac{1}{4}n)$–$(\frac{1}{2}n)$ of the wavelength of the incident light. The rough surface morphology of the ground plane is obtained, as determined by experiments, by selective deposition of the ground plane layer 24 on the PET substrate through a fine mesh screen so that the final thin film would have the desired degree of surface roughness. Several methods for the selected deposition will be described below with reference to FIGS. 5*a*, 5*b*.

Figure 5A:
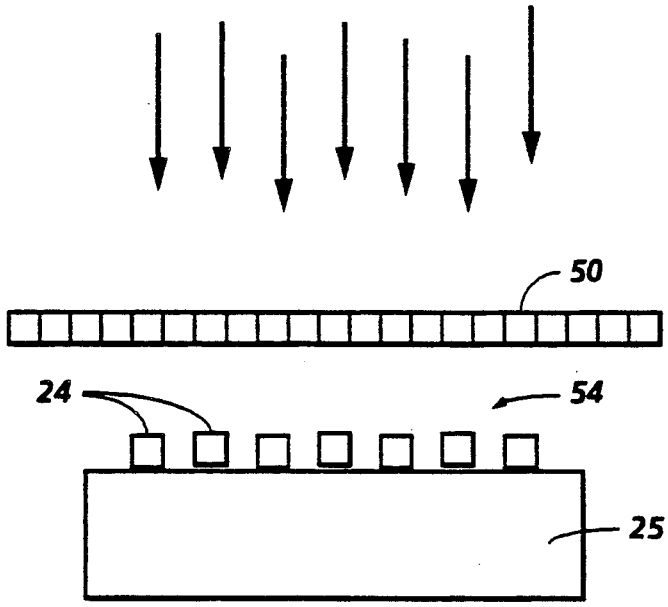
FIG. 5 is a schematic diagram showing one embodiment where metal deposition of the ground plane on a substrate is made through (a) a stationary screen or (b) a vibrating fine mesh screen.
Figure 5B:
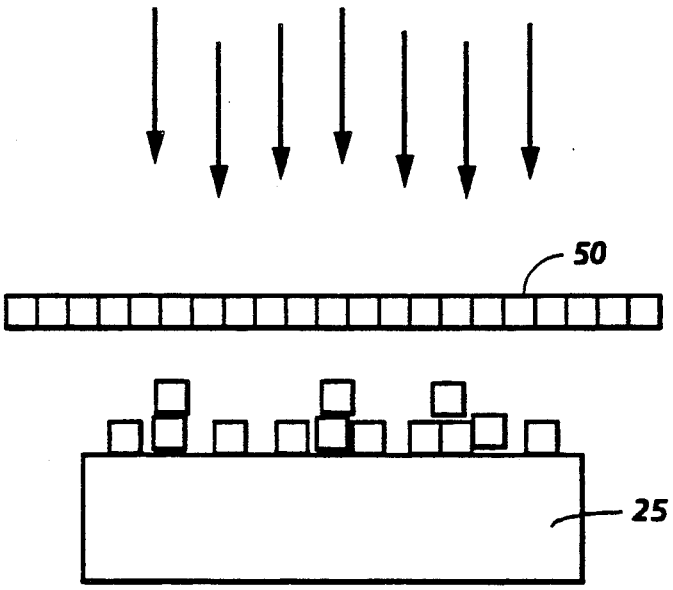

FIG. 5*a* is a schematic drawing showing a metal being deposited through a screen 50 to form a metalized ground plane on a PET substrate 25. The ground plane will be formed either with a regular morphology (FIG. 5*a*) or irregular morphology (FIG. 5*b*). In a first technique screen 50 is rotated or moved between successive metal deposition passes to create the ground plane. Alternatively, the entire ground plane may be formed by a one-pass deposition of the metal while vibrating screen 50 at some optimum frequency. The latter method results again in the formation of ground plane with a rough irregular surface morphology. A ground plane with regular morphology (FIG. 5*a*) is formed by one-pass deposition of the metal to a stationary screen 50 to create a grid or a dot pattern ground plane.

While the above technique was described in the context of forming the ground plane itself on an underlying substrate, the metal may alternatively be deposited on a ground plane already formed on the PET substrate. In fact, this latter technique may be preferred for more systems, since this would ensure that there are no bare spots devoid of metal on the PET substrate, a possible result of forming the ground plane through the screen deposition process.

EXAMPLE

Figure 1:
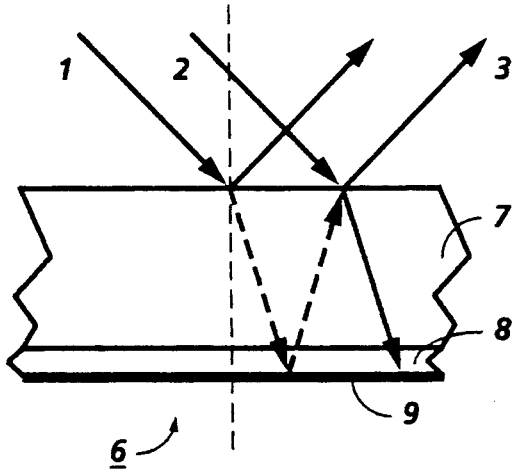
FIG. 1 PRIOR ART
FIG. 1 shows coherent light incident upon a prior art layered photosensitive medium leading to reflections internal to the medium.
Figure 2:
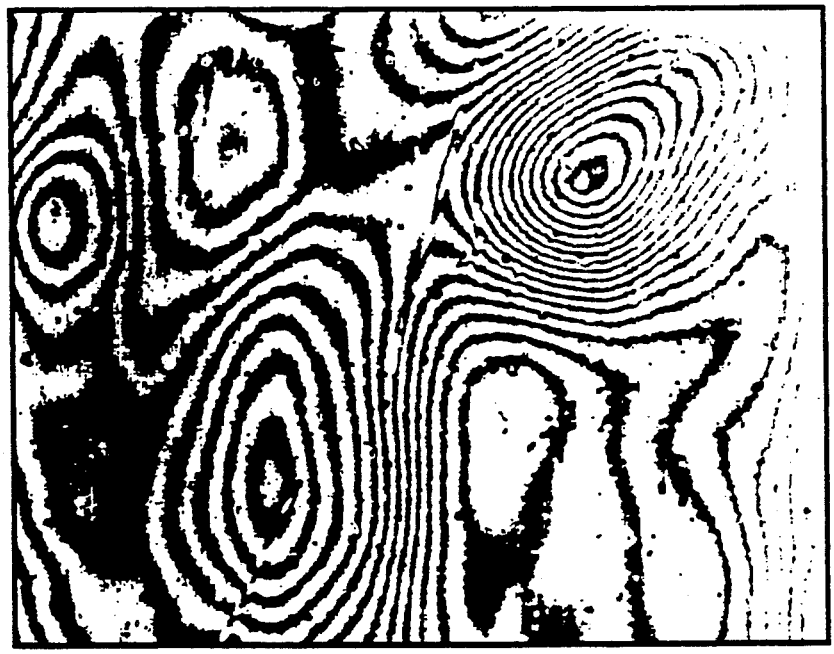
FIG. 2 shows a spatial exposure variation plywood pattern in the exposed photosensitive medium of FIG. 1 produced when the spatial variation in the absorption within the photosensitive member occurs due to an interference effect.

A photoreceptor was formed according to the FIG. 4 embodiment, but with the charge generator layer 26 eliminated to enable a better comparison with the interference pattern shown in FIG. 2 which similarly eliminated the charge generator layer. A titanium ground plane 24 was formed by the selected deposition techniques described above. A 500 mesh screen was used during a deposition process to create a regular optical grid pattern. The photoreceptor was illuminated by helium-neon laser at 633 nm. It was found that the interference fringe had much weaker contrast, since the coherence of reflection from the ground plane is broken up by the grid pattern morphology of the ground plane. The suppression of the interference fringes is directly correlated to the suppression that would be shown in xerographic prints made from images formed on the photoreceptor of FIG. 4.

Through optical calculations and numerous experiments with different samples exhibiting different degrees of roughness on the metal ground plane surface, the following geometrical parameters were found to be optimum for suppression of the interference fringe contrast:

1) $a < 45$ microns grid spacing provides effective scattering.
2) onset of significant suppression of the interference fringes was observed at 150 nm peak to peak roughness at 633 nm wavelength of incident beam source.
3) nearly total suppression of interference fringes is obtained at 250 nm peak to peak roughness at 633 nm wavelength of incident beam source.

While the invention has been described with reference to the structure disclosed, it will be appreciated that numerous changes and modifications are likely to occur to those skilled in the art, and it is intended to cover all changes and modifications which fall within the true spirit and scope of the invention.

We claim:

1. A process for forming a photosensitive imaging member comprising the steps of providing a dielectric substrate selectively depositing a metal onto the dielectric substrate through a screen, thereby forming a conductive ground plane on said substrate which has a rough surface morphology and overlying said conductive ground plane with at least a charge transport layer and charge generating layer.

2. The process of claim 1, wherein the average roughness of said ground plane surface is at least $\frac{1}{4}n$ the wavelength of said incident light, where n is the index of refraction of the medium in which the light travels.

3. The process of claim 1, wherein the incident light is in a wavelength range of 400 to 900 nm and the average roughness of said ground plane surface is from $\lambda/4$ n to $\lambda/2$ n peak-to-peak, where $\lambda$ is the wavelength of the light.

4. The process of claim 1 wherein the screen is a fine mesh screen.

5. The process of claim 4, wherein said ground plane is formed by multiple passes through said screen, the position of the screen being moved following each deposition whereby the ground plane surface acquires an irregular morphology.

6. The process of claim 4, wherein said ground plane is formed by a single pass through a vibrating mesh screen whereby the ground plane acquires an irregular morphology.

7. The process of claim 4, wherein said ground plane is formed by a single pass through a stationary screen whereby the surface of said ground plane acquires a regular grid pattern morphology.

8. The process of claim 1 further including the step of forming the ground plane on the dielectric substrate and subsequently depositing an additional rough metal layer on the ground plane surface through a fine mesh screen.

9. The process of claim 8 whereby said additional ground plane layer is formed by multiple passes through said screen, the position of the screen moved following each deposition.

10. The process of claim 8 wherein said ground plane is formed by a single pass through a vibrating mesh screen.

11. The process of claim 8 wherein said additional metal layer is formed by a single pass through a stationary screen whereby the deposited ground surface acquires places a regular grid pattern morphology on the underlying metal substrate.

* * * * *